US011701597B2

(12) United States Patent
Kwan

(10) Patent No.: US 11,701,597 B2
(45) Date of Patent: Jul. 18, 2023

(54) CAR TYPE MODEL

(71) Applicants: GATEWAY AUTOART JAPAN CORPORATION, Fuefuki (JP); GATEWAY AUTOART LIMITED, Hong Kong (HK)

(72) Inventor: Kelvin Yuet-Ming Kwan, Hong Kong (HK)

(73) Assignees: GATEWAY AUTOART JAPAN CORPORATION, Fuefuki (JP); GATEWAY AUTOART LIMITED, Hong Kong (HK)

( * ) Notice: Subject to any disclaimer, the term of this patent is extended or adjusted under 35 U.S.C. 154(b) by 184 days.

(21) Appl. No.: 17/337,058

(22) Filed: Jun. 2, 2021

(65) Prior Publication Data

US 2022/0126214 A1 Apr. 28, 2022

(30) Foreign Application Priority Data

Oct. 23, 2020 (CN) ..... 202011145633.3

(51) Int. Cl.
*A63H 17/26* (2006.01)

(52) U.S. Cl.
CPC ..... *A63H 17/262* (2013.01)

(58) Field of Classification Search
CPC ..... A63H 17/00; A63H 17/002; A63H 17/26; A63H 17/262
USPC ..... 446/465, 469, 470
See application file for complete search history.

(56) References Cited

U.S. PATENT DOCUMENTS 3,711,989 A * 1/1973 Nielsen ..... A63H 17/262 446/469
4,466,215 A * 8/1984 Hanazato ..... A63H 33/003 446/469
4,533,336 A * 8/1985 Dixon ..... A63H 17/26 312/219
4,986,789 A * 1/1991 Hang ..... G09B 19/00 446/470
5,120,254 A * 6/1992 Daniels ..... A63H 17/262 446/469
5,919,077 A * 7/1999 Gondcaille ..... A63H 17/262 446/469
7,568,962 B2 * 8/2009 Amadio ..... A63H 17/002 446/470

(Continued)

FOREIGN PATENT DOCUMENTS

CN 204488950 U 7/2015
DE 3903411 A1 9/1990

(Continued)

OTHER PUBLICATIONS

First Examination Report dated Apr. 5, 2022 by IP Australia for counterpart Australian Patent Application No. 2021203453.

(Continued)

*Primary Examiner* — Alexander R Niconovich
(74) *Attorney, Agent, or Firm* — Ladas & Parry LLP

(57) ABSTRACT

The present disclosure relates to a car type model comprising an inner structure formed of a metal, a chassis formed of a resin and a wheel axle formed of a metal. The chassis is attached to the inner structure, and the wheel axle is arranged between the chassis and the inner structure. The inner structure and the chassis are configured to keep the wheel axle in a position.

15 Claims, 12 Drawing Sheets

(56) References Cited

U.S. PATENT DOCUMENTS

| | | | | |
|---|---|---|---|---|
| 9,636,602 | B1 * | 5/2017 | Sarno | A63H 17/002 |
| 10,335,699 | B2 * | 7/2019 | Kwan | A63H 17/262 |
| 10,709,994 | B2 * | 7/2020 | Kwan | A63H 17/262 |
| 2005/0250415 | A1 * | 11/2005 | Barthold | A63H 17/00 446/465 |
| 2005/0250416 | A1 * | 11/2005 | Barthold | A63F 1/04 446/465 |
| 2005/0287925 | A1 * | 12/2005 | Proch | G06Q 30/06 446/470 |
| 2006/0076735 | A1 * | 4/2006 | Proch | A63H 17/262 273/298 |
| 2007/0202773 | A1 * | 8/2007 | Yuen | A63H 17/002 446/94 |
| 2011/0014850 | A1 * | 1/2011 | Kennedy | A63H 17/14 446/465 |
| 2011/0263181 | A1 * | 10/2011 | Kreidler | A63H 17/26 446/470 |
| 2012/0276809 | A1 * | 11/2012 | Verbera | A63H 17/36 446/465 |
| 2014/0065927 | A1 * | 3/2014 | Su | G01G 17/00 177/1 |
| 2017/0014724 | A1 * | 1/2017 | Kwan | A63H 17/262 |
| 2019/0160386 | A1 * | 5/2019 | Kwan | A63H 17/262 |
| 2021/0129036 | A1 * | 5/2021 | Dragusin | A63H 17/264 |

FOREIGN PATENT DOCUMENTS

| | | | |
|---|---|---|---|
| EP | 3488908 | A1 | 5/2019 |
| EP | 3488908 | B1 | 5/2020 |
| GB | 1040369 | A | 8/1966 |
| GB | 2302039 | A | 1/1997 |
| HK | 1184013 | A2 | 1/2014 |
| JP | 56-59093 | | 12/2014 |
| JP | 6313863 | B2 | 3/2018 |
| JP | 2019-97582 | A | 6/2019 |
| JP | 6535069 | B2 | 6/2019 |
| WO | 2006041653 | A2 | 4/2006 |

OTHER PUBLICATIONS

European Search Report dated Nov. 19, 2021 from the European Patent Office (EPO).
DE3903411A1 dated Sep. 20, 1990 English Translation.
HK 1184013 A2 dated Jan. 10, 2014 English Translation.
JP 6313863 B2 _ English Abstract.
JP 6535069 B2 _ English Abstract.
Office Action in counterpart Japanese application JP Patent Application No. 2020-2143 98 dated Dec. 27, 2021 including Summary English Translation.

* cited by examiner

CAR TYPE MODEL

BACKGROUND

1. Field of the Disclosure

The instant disclosure relates to, amongst other things, a car type model having metal axles arranged between a metal inner structure and a resin chassis, wherein the metal inner structure and the resin chassis are configured to receive the metal axles and keep the metal axles in positions.

2. Description of Related Art

Conventionally, a car type model (a minicar) is broadly popular as a toy for children or as ornaments which can be endured to see by adults. The ornamental minicar is a commercial product for a user who wants to take a look and enjoy beauty of the minicar and wants to keep at least a shape of a desirable car at a hand. For this reason, it is demanded to finely fabricate the minicar in order to be intimate an authentic car as greatly as possible. Therefore, there are offered minicars for ornamental purpose which really reproduces authentic cars from exterior decors to interior decors.

However, the common car type model is made of a resin, and thus the common car type may be easily damaged and exhibit poor feeling. Further, the resin car body cannot protect the wheel axle which arranged within the resin car body from being damaged, and thus the wheel axle cannot be positioned firmly and may be bent.

SUMMARY

According to one example embodiment of the instant disclosure, a car type model includes an inner structure formed of a metal, a chassis formed of a resin and a wheel axle formed of a metal. The chassis is attached to the inner structure, and the wheel axle is arranged between the chassis and the inner structure. The inner structure and the chassis are configured to receive the wheel axle and keep the wheel axle in a position.

According to another example embodiment of the instant disclosure, a car type model includes a chassis formed of a resin and comprising at least one slot, a wheel axle received in the slot; and an inner structure formed of a metal and attached to the chassis. The inner structure covers the slot of the chassis such that the wheel axle is kept in the slot of the chassis.

In order to further understanding of the instant disclosure, the following embodiments are provided along with illustrations to facilitate appreciation of the instant disclosure; however, the appended drawings are merely provided for reference and illustration, and do not limit the scope of the instant disclosure.

DETAILED DESCRIPTION

Figure 1:
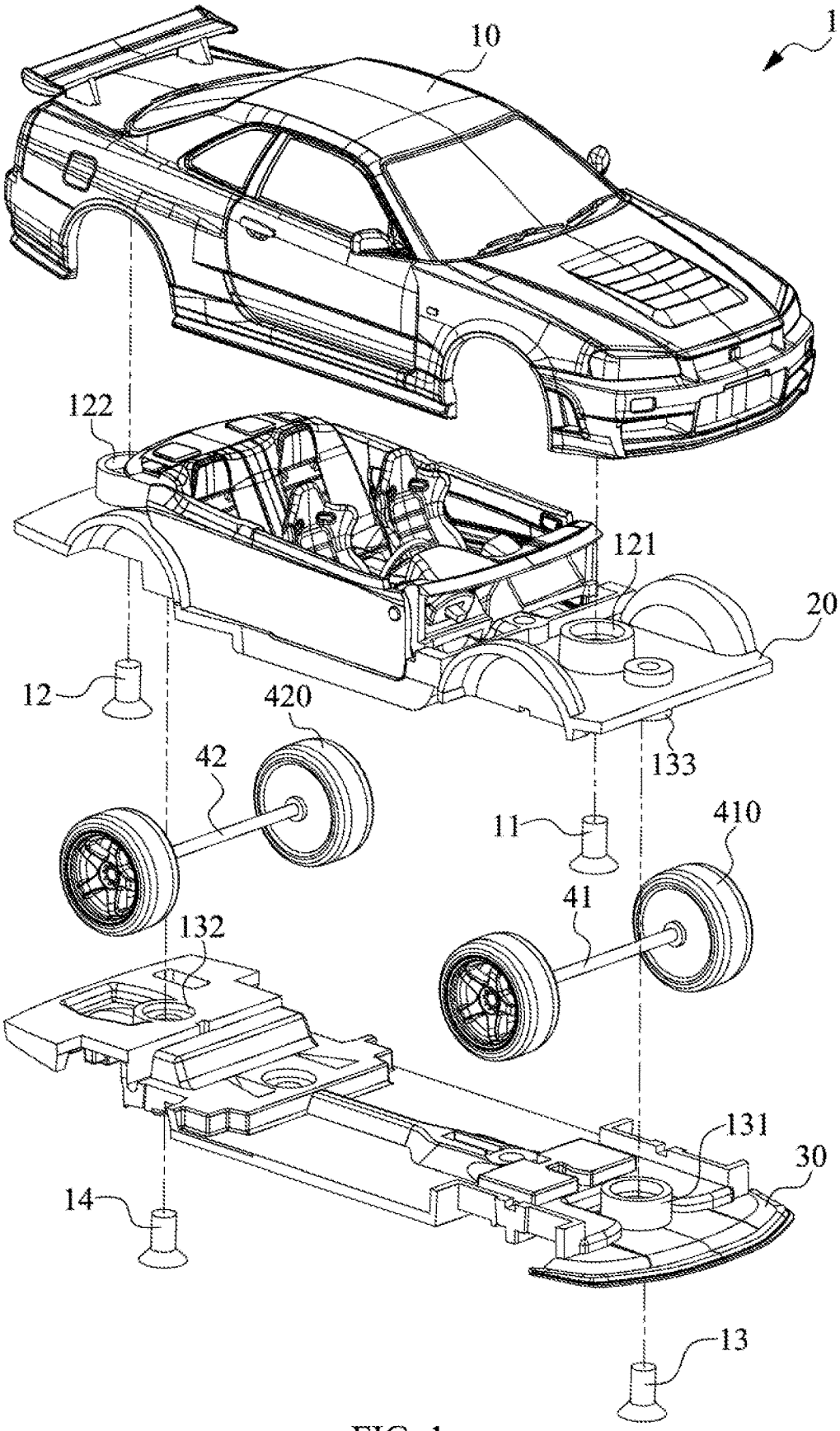
FIG. 1 is an exploded view of a car type model in accordance with some embodiments of the present disclosure.

The following disclosure provides for many different embodiments, or examples, for implementing different features of the provided subject matter. Specific examples of components and arrangements are described below to explain certain aspects of the present disclosure. These are, of course, merely examples and are not intended to be limiting. For example, the formation of a first feature over or on a second feature in the description that follows may include embodiments in which the first and second features are formed or disposed in direct contact, and may also include embodiments in which additional features are formed or disposed between the first and second features, such that the first and second features are not in direct contact. In addition, the present disclosure may repeat reference numerals and/or letters in the various examples. This repetition is for the purpose of simplicity and clarity and does not in itself dictate a relationship between the various embodiments and/or configurations discussed.

As used herein, spatially relative terms, such as "beneath," "below," "above," "over," "on," "upper," "lower," "left," "right," "vertical," "horizontal," "side" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The device may be otherwise oriented (rotated 90 degrees or at other orientations) and the spatially relative descriptors used herein may likewise be interpreted accordingly. It should be understood that when an element is referred to as being "connected to" or "coupled to" another element, it may be directly connected to or coupled to the other element, or intervening elements may be present.

Present disclosure provides a car type model having a metal inner structure. The metal inner structure is configured to support wheel axles and protect the wheel axles from being bent or deformed. Further, the metal inner structure holds the wheel axles in position and allows the wheel axles to rotate freely. Moreover, the metal inner structure can increase the weight of the car type model such that the car type model car exhibits the massive feeling.

FIG. 1 is an exploded view of a car type model in accordance with an embodiment of the present disclosure. As shown in FIG. 1, the car type model 1 includes a car body 10, an inner structure 20 and a chassis 30. The car body 10 may be made of a resin. The inner structure 20 may be made of a metal. In some embodiments of the present disclosure, the inner structure 20 is made of zinc die-cast alloy. Further, the chassis 30 may be made of a resin.

Referring to FIG. 1, the inner structure 20 may be attached to the car body 10 by fixing screws 11 and 12. In some embodiments of the present disclosure, the fixing screws 11 and 12 are made of a metal. The fixing screws 11 and 12 are screwed into the screw holes 121 and 122 provided on the inner structure 20 and the screw holes provided on the car body 10 (not shown). The chassis 30 may be attached to the inner structure 20 by fixing screws 13 and 14. In some embodiments of the present disclosure, the fixing screws 13 and 14 are made of a metal. The fixing screws 13 and 14 are screwed into the screw holes 131 and 132 provided on the chassis 30 and the screw holes 133 and 134 provided on the inner structure 20 (see FIG. 4). Further, a wheel axle 41 with front wheels 410 and a wheel axle 42 with rear wheels 420 may be arranged between the inner structure 20 and the chassis 30. The wheel axles 41 and 42 may be made of a metal. In some embodiments of the present disclosure, the wheel axles 41 and 42 are made of stainless steel.

Figure 2:
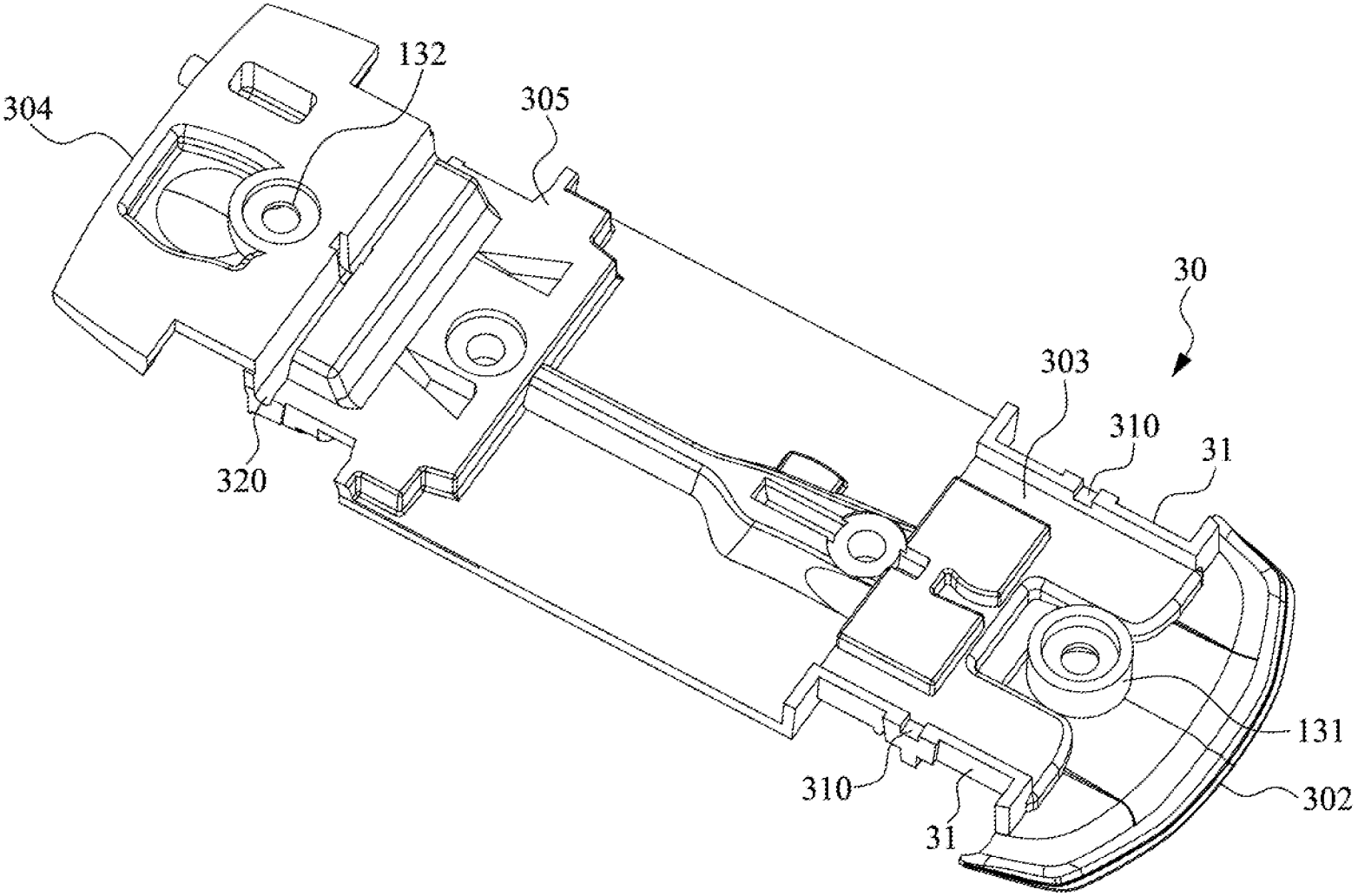
FIG. 2 is a perspective view showing a chassis of a car type model in accordance with some embodiments of the present disclosure.

FIG. 2 is a perspective view showing a chassis of a car type model in accordance with some embodiments of the present disclosure. As shown in FIG. 2, the chassis 30 includes a pair of the front retainers 31 which is positioned close to a front end 302 of the chassis 30. In some embodiments of the present disclosure, the front retainer 31 protrudes from an upper surface 303 which may face the inner structure 20 when the chassis 30 is attached to the inner structure 20. Each of the front retainers 31 includes a slot 310 which is configured to receive the front wheel axle 41. In some embodiments of the present disclosure, the front slot 310 may be a U-shaped slot. That is, the front slot 310 may have a U-shaped cross-section.

As show in FIG. 2, the chassis 30 further includes a rear slot 320 which is configured to receive the rear wheel axle 42. The slot 320 is positioned close to a rear end 304 of the chassis 30. In some embodiments of the present disclosure, the rear slot 320 is formed on an upper surface 305 which may face the inner structure 20 when the chassis 30 is attached to the inner structure 20. The rear slot 320 may be recessed with respect to the upper surface 305. In some embodiments of the present disclosure, the rear slot 320 may be a U-shaped slot. That is, the rear slot 320 may have a U-shaped cross-section.

The front wheel axle 41 with the front wheels 410 may be received in the front slots 310 and the rear wheel axle 42 with the rear wheels 420 may be received in the rear slot 320. That is, a position of the front wheel axle 41 may be defined by the front slots 310, and a position of the rear wheel axle 42 may be defined by the rear slot 320.

In some embodiments of the present disclosure, the screw holes 131 and 132 are formed to align with a central line longitudinally extending the chassis 30.

Figure 3:
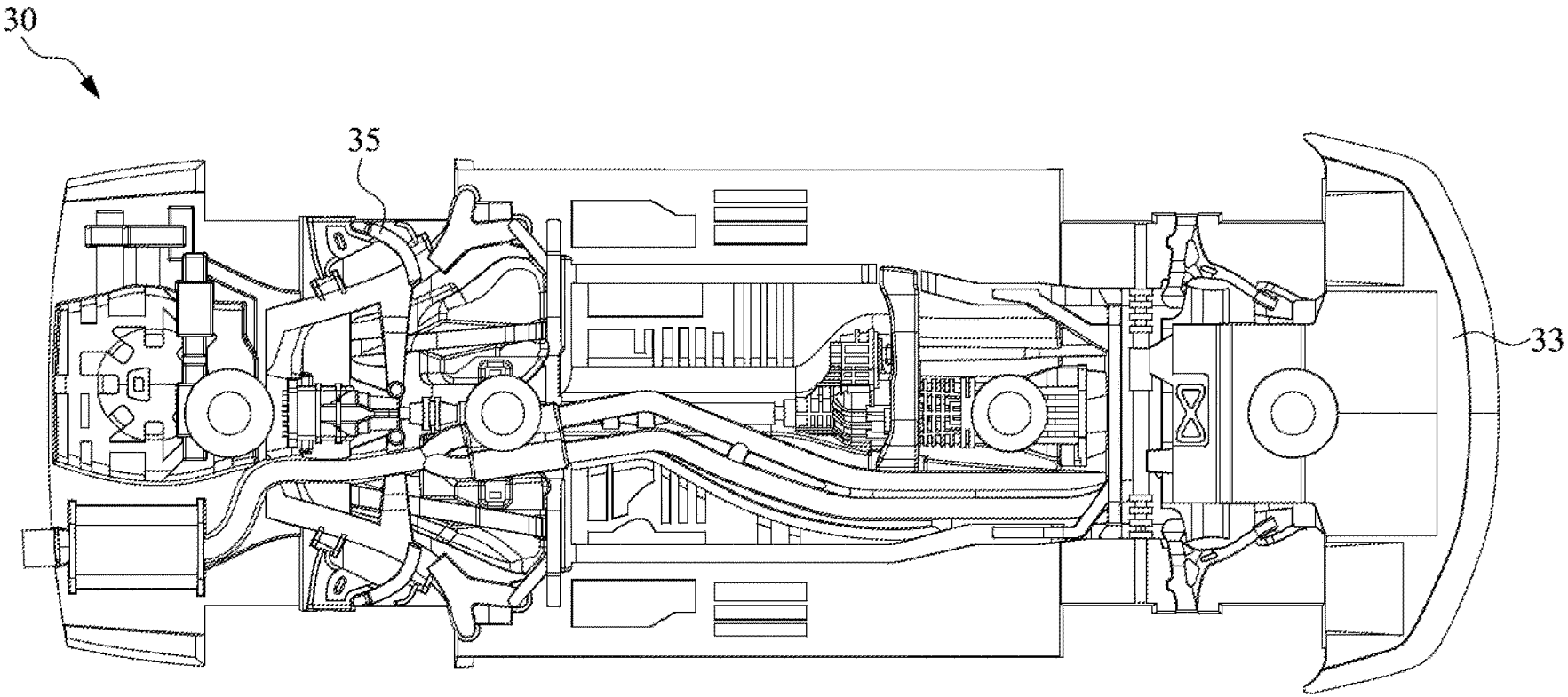
FIG. 3 is a bottom view showing a chassis of a car type model in accordance with some embodiments of the present disclosure.

FIG. 3 is a bottom view showing a chassis of a car type model in accordance with some embodiments of the present disclosure. Referring to FIG. 3, the chassis 30 includes a lower surface 33 which faces away the inner structure 20 when the chassis 30 is attached to the inner structure 20. In some embodiments of the present disclosure, the lower surface 33 of the chassis 30 includes a relief pattern 35 showing the transmission mechanism and the exhaust system of the car. Since the chassis 30 is formed of the resin, the relief pattern 35 may be formed by a molding process.

Figure 4:
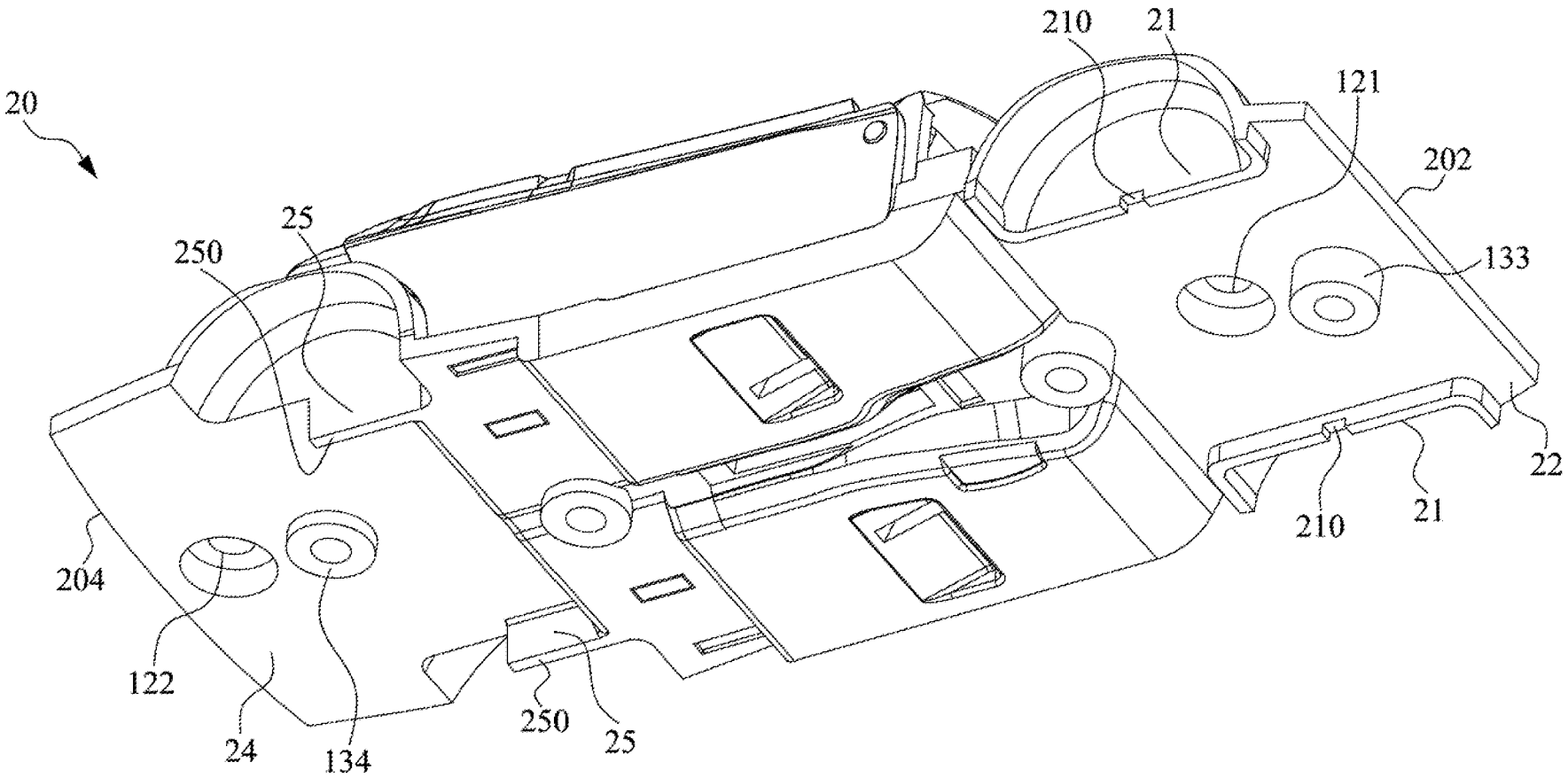
FIG. 4 is a perspective view showing an inner structure of a car type model in accordance with some embodiments of the present disclosure.

FIG. 4 is a perspective view showing an inner structure of a car type model in accordance with some embodiments of the present disclosure. The inner structure 20 includes a pair of the retainers 21 positioned close to a front end 202 of the inner structure 20 and protruded from a lower surface 22 of the inner structure 20. The lower surface 22 of the inner structure 20 may face the chassis 30 when the inner structure 20 and the chassis 30 are attached to each other. In some embodiments of the present disclosure, each of the retainers 21 has a slot 210. In some embodiments of the present disclosure, the positions of the retainers 21 of the inner structure 20 respectively correspond to the positions of the front retainers 31 of the chassis 30 and the positions of the slots 210 of the retainers 21 of the inner structure 20 respectively correspond to the positions of the slots 310 of the retainers 31 of the chassis 30. Thus, when the inner structure 20 and the chassis 30 are attached to each other, the retainers 21 of the inner structures 20 may respectively match the front retainers 31 of the chassis 30 and the slots 210 of the retainers 21 of the inner structure 20 may respectively align with the slots 310 of the retainers 31 of the chassis 30.

The inner structure 20 includes a pair of the retainer 25 positioned close to a rear end 204 of the inner structure 20 and protruded from a lower surface 24 of the inner structure 20. The lower surface 24 of the inner structure 20 may face the chassis 30 when the inner structure 20 and the chassis 30 are attached to each other. In some embodiments of the present disclosure, each of the retainers 25 has a flat lower surface 250. In some embodiments of the present disclosure, the positions of the retainers 25 of the inner structure 20 correspond to the position of the slot 320 of the chassis 30. Thus, when the inner structure 20 and the chassis 30 are attached to each other, the lower surfaces 250 of the retainers 25 of the inner structure 20 may face the chassis 30 and cover the slot 320 of the front retainers 31.

In some embodiments of the present disclosure, the screw holes 121, 122, 133 and 134 are formed to align with a central line longitudinally extending the inner structure 20.

Figure 5A:
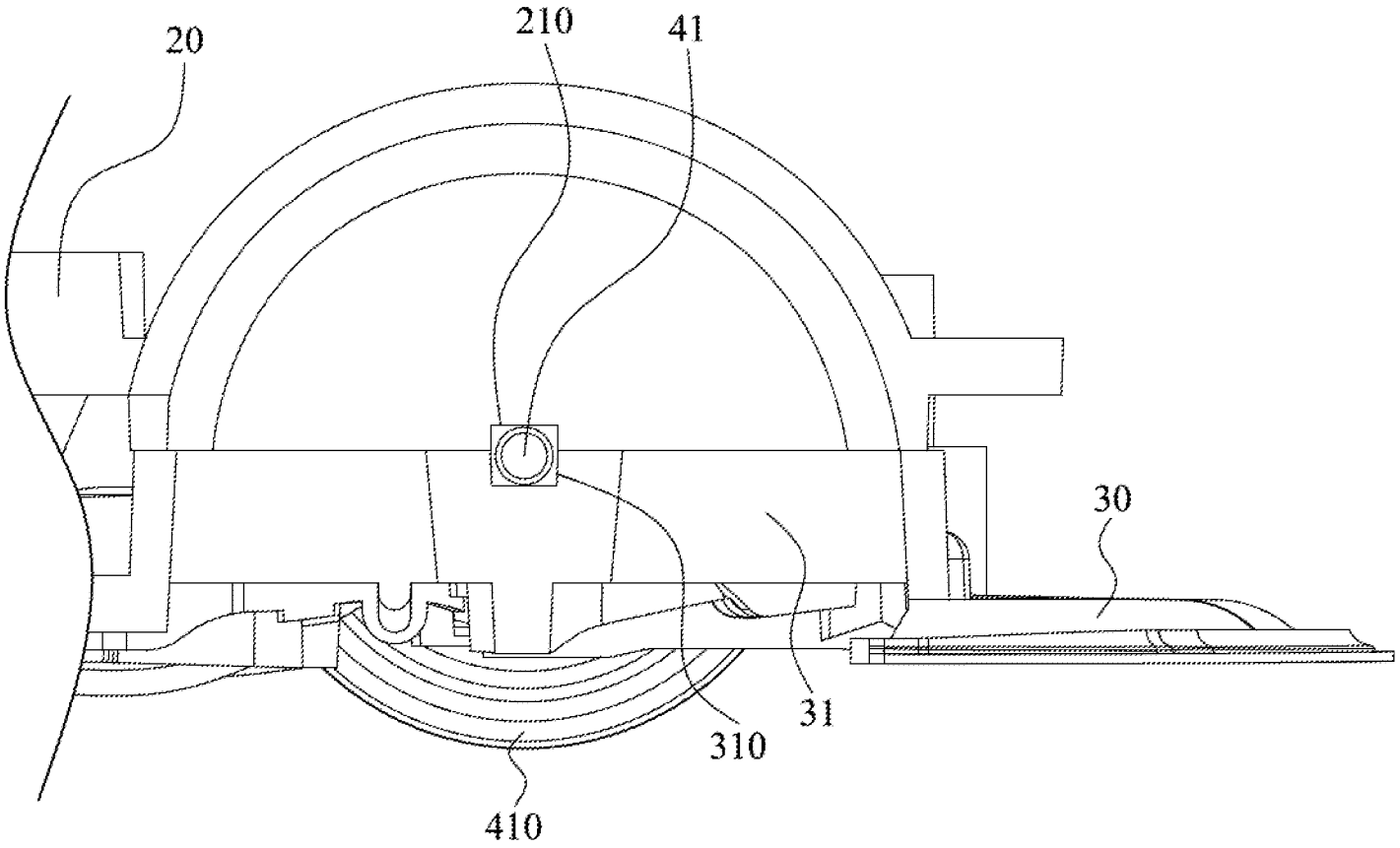
FIG. 5A is an enlarged cross-sectional view showing a portion of a combination of an inner structure and a chassis of a car type model in accordance with some embodiments of the present disclosure.

FIG. 5A is an enlarged cross-sectional view showing a portion of a combination of an inner structure and a chassis of a car type model in accordance with some embodiments of the present disclosure. As shown in FIG. 5A, the slot 210 of the retainer 21 of the inner structure 20 substantially aligns with the slot 310 of the retainer 31 of the chassis 30 when the inner structure 20 and the chassis 30 are attached to each other. Referring to FIG. 5A, the front wheel axle 41 is received in the slot 210 of the retainer 21 of the inner structure 20 and the slot 310 of the retainer 31 of the chassis 30, and thus the front wheel axle 41 is positioned by the slot 210 of the inner structure 20 and the slot 310 of the chassis 30. That is, the inner structure 20 and the chassis 30 are configured to keep the front wheel axle 41 in a position. In some embodiments of the present disclosure, a cross-sectional width of the slot 210 of the inner structure 20 is greater than a diameter of the front wheel axle 41 and a cross-sectional width of the slot 310 of the chassis 30 is greater than the diameter of the front wheel axle 41, and thus the front wheel axle 41 rotates freely in the slot 210 of the inner structure 20 and the slot 310 of the chassis 30.

In some embodiments of the present disclosure, the slot 210 of the inner structure 20 and the slot 310 of the chassis 30 are configured to fit the wheel axle 41, and the wheel axle 41 is fixed and cannot rotate freely when the wheel axle 41 is arranged between the inner structure 20 and chassis 30. The wheel 410 may rotatably connects the end of the wheel axle 41, and thus the wheel 410 may rotate freely while the wheel axle 41 is fixed between the inner structure 20 and chassis 30.

Figure 5B:
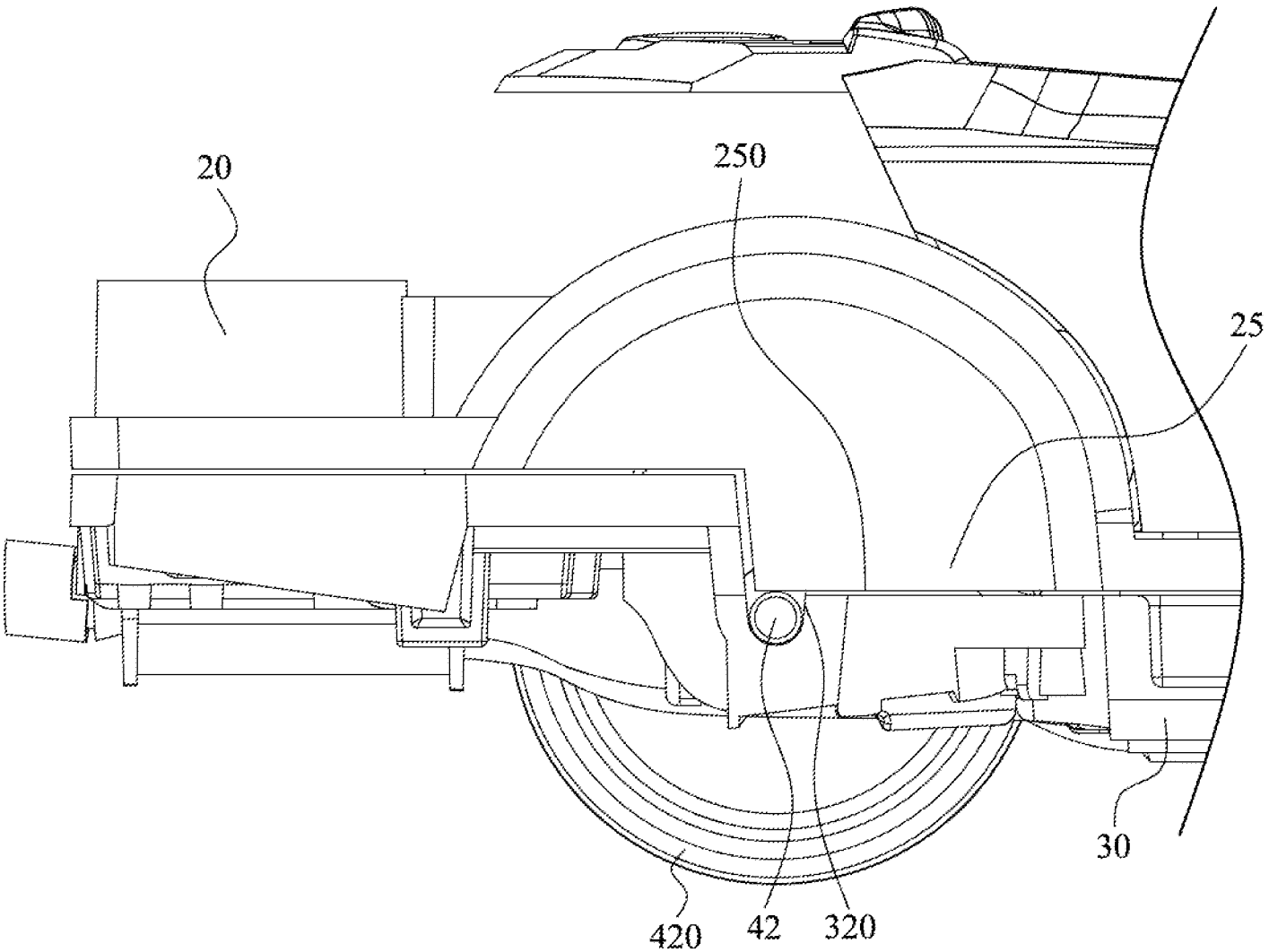
FIG. 5B is an enlarged cross-sectional view showing another portion of a combination of an inner structure and a chassis of a car type model in accordance with some embodiments of the present disclosure.

FIG. 5B is an enlarged cross-sectional view showing another portion of a combination of an inner structure and a chassis of a car type model in accordance with some embodiments of the present disclosure. As shown in FIG. 5B, the lower surface 250 of the retainer 25 of the inner structure substantially covers the slot 320 of the chassis 30 when the inner structure 20 and the chassis 30 are attached to each other. Referring to FIG. 5B, the rear wheel axle 42 is received in the slot 320 the chassis 30 and blocked by the lower surface 250 of the retainer 25 of the inner structure 20, and thus the rear wheel axle 42 is positioned by the slot 320 of the retainer 30 and the lower surface 250 of the retainer 25 of the inner structure 20. That is, the inner structure 20 and the chassis 30 are configured to keep the rear wheel axle 42 in a position. In some embodiments of the present disclosure, a cross-sectional width of the slot 320 is greater than a diameter of the rear wheel axle 42, and thus the rear wheel axle 42 rotates freely in the slot 320.

In some embodiments of the present disclosure, the slot 320 of the chassis 30 is configured to fit the wheel axle 42, and the wheel axle 42 is fixed and cannot rotate freely when the wheel axle 42 is arranged between the inner structure 20 and chassis 30. The wheel 420 may rotatably connects the end of the wheel axle 42, and thus the wheel 420 may rotate freely while the wheel axle 42 is fixed between the inner structure 20 and chassis 30.

Figure 6:
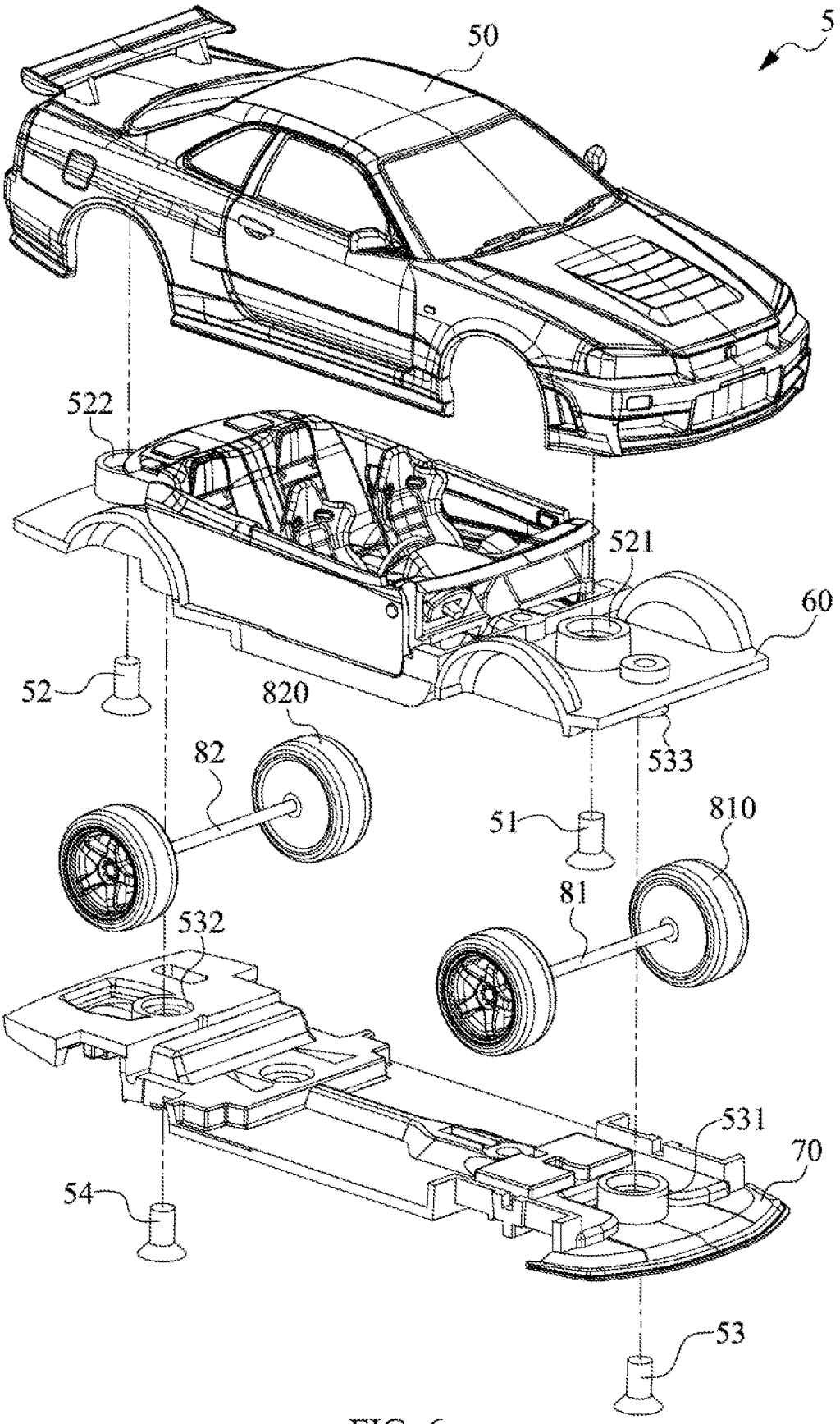
FIG. 6 is an exploded view of a car type model in accordance with some embodiments of the present disclosure.

FIG. 6 is an exploded view of a car type model in accordance with an embodiment of the present disclosure. As shown in FIG. 6, the car type model 5 includes a car body 50, an inner structure 60 and a chassis 70. The car body 50 may be made of a resin. The inner structure 60 may be made of a metal. In some embodiments of the present disclosure, the inner structure 60 is made of zinc die-cast alloy. Further, the chassis 70 may be made of a resin.

Referring to FIG. 6, the inner structure 60 may be attached to the car body 50 by fixing screws 51 and 52. In some embodiments of the present disclosure, the fixing screws 51 and 52 are made of a metal. The fixing screws 51 and 52 are screwed into the screw holes 521 and 522 provided on the inner structure 60 and the screw holes provided on the car body 50 (not shown). The chassis 70 may be attached to the inner structure 60 by fixing screws 53 and 54. In some embodiments of the present disclosure, the fixing screws 53 and 54 are made of a metal. The fixing screws 53 and 54 are screwed into the screw holes 531 and 532 provided on the chassis 70 and the screw holes 533 and 534 provided on the inner structure 60 (see FIG. 9). Further, a wheel axle 81 with front wheels 810 and a wheel axle 82 with rear wheels 820 may be arranged between the inner structure 60 and the chassis 70. The wheel axles 81 and 82 may be made of a metal. In some embodiments of the present disclosure, the wheel axles 81 and 82 are made of stainless steel.

Figure 7:
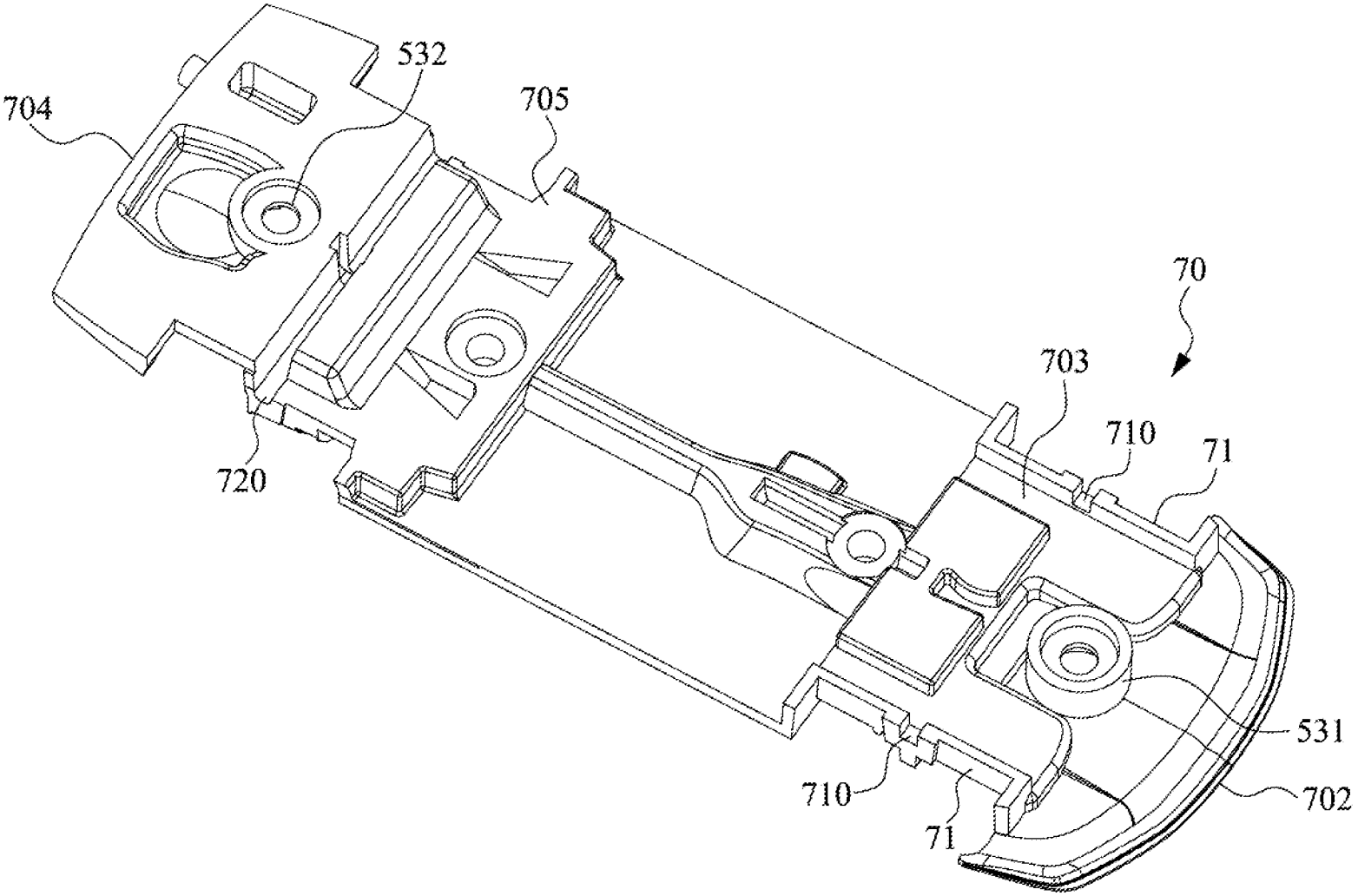
FIG. 7 is a perspective view showing a chassis of a car type model in accordance with some embodiments of the present disclosure.

FIG. 7 is a perspective view showing a chassis of a car type model in accordance with some embodiments of the present disclosure. As shown in FIG. 7, the chassis 70 includes a pair of the front retainers 71 which is positioned close to a front end 702 of the chassis 70. In some embodiments of the present disclosure, the front retainer 71 protrudes from an upper surface 703 which may face the inner structure 60 when the chassis 70 is attached to the inner structure 60. Each of the front retainers 71 includes a slot 710 which is configured to receive the front wheel axle 81. In some embodiments of the present disclosure, the front slot 710 may be a U-shaped slot. That is, the front slot 710 may have a U-shaped cross-section.

As show in FIG. 7, the chassis 70 further includes a rear slot 720 which is configured to receive the rear wheel axle 82. The slot 720 is positioned close to a rear end 704 of the chassis 70. In some embodiments of the present disclosure, the rear slot 720 is formed on an upper surface 705 which may face the inner structure 60 when the chassis 70 is attached to the inner structure 60. The rear slot 720 may be recessed with respect to the upper surface 705. In some embodiments of the present disclosure, the rear slot 720 may be a U-shaped slot. That is, the rear slot 720 may have a U-shaped cross-section.

The front wheel axle 81 with the front wheels 810 may be received in the front slots 710 and the rear wheel axle 82 with the rear wheels 820 may be received in the rear slot 720. That is, a position of the front wheel axle 81 may be defined by the front slots 710, and a position of the rear wheel axle 82 may be defined by the rear slot 720.

In some embodiments of the present disclosure, the screw holes 531 and 532 are formed to align with a central line longitudinally extending the chassis 70.

Figure 8:
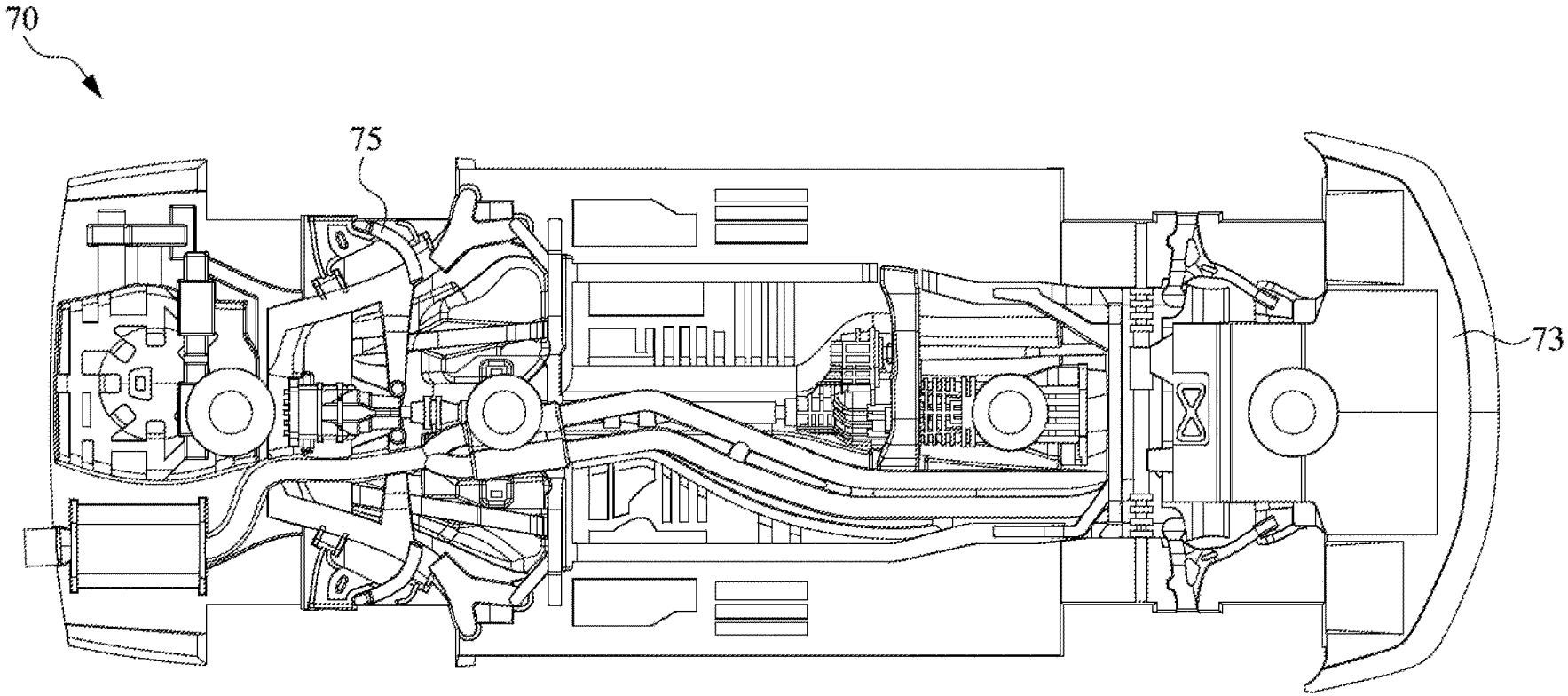
FIG. 8 is a bottom view showing a chassis of a car type model in accordance with some embodiments of the present disclosure.

FIG. 8 is a bottom view showing a chassis of a car type model in accordance with some embodiments of the present disclosure. Referring to FIG. 8, the chassis 70 includes a lower surface 73 which faces away the inner structure 60 when the chassis 70 is attached to the inner structure 60. In some embodiments of the present disclosure, the lower surface 73 of the chassis 70 includes a relief pattern 75 showing the transmission mechanism and the exhaust system of the car. Since the chassis 70 is formed of the resin, the relief pattern 75 may be formed by a molding process.

Figure 9:
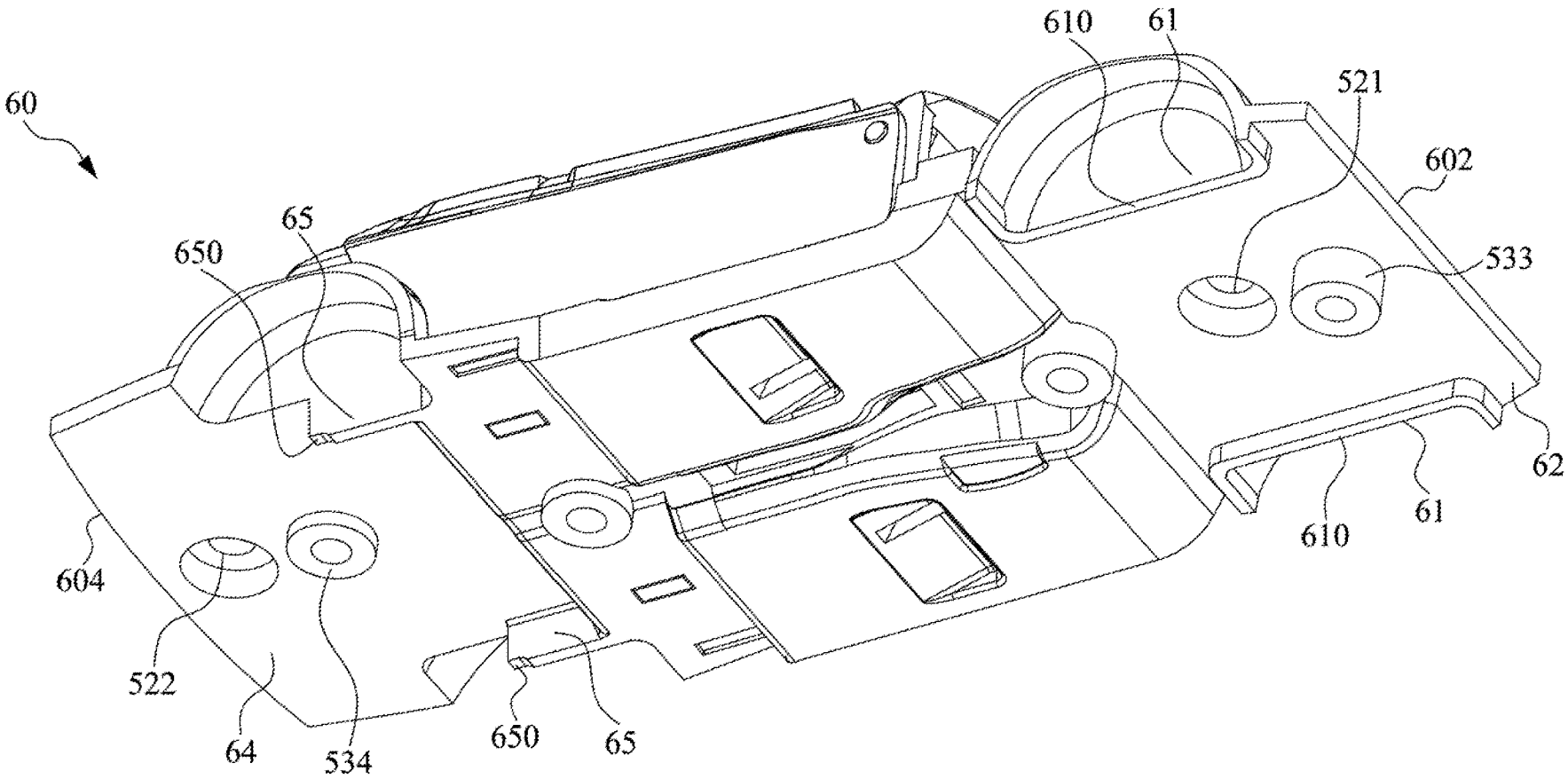
FIG. 9 is a perspective view showing an inner structure of a car type model in accordance with some embodiments of the present disclosure.

FIG. 9 is a perspective view showing an inner structure of a car type model in accordance with some embodiments of the present disclosure. The inner structure 60 includes a pair of the retainers 61 positioned close to a front end 602 of the inner structure 60 and protruded from a lower surface 62 of the inner structure 60. The lower surface 62 of the inner structure 60 may face the chassis 70 when the inner structure 60 and the chassis 70 are attached to each other. In some embodiments of the present disclosure, each of the retainers 61 has a flat lower surface 610. In some embodiments of the present disclosure, the positions of the retainers 61 of the inner structure 60 respectively correspond to the positions of the front retainers 71 of the chassis 70. Thus, when the inner structure 60 and the chassis 70 are attached to each other, the retainers 61 of the inner structures 60 may respectively match the front retainers 71 of the chassis 70 and the lower surfaces 610 of the retainers 51 may face the chassis 70 and respectively cover the slots 710 of the front retainers 71.

The inner structure 60 includes a pair of the retainer 65 positioned close to a rear end 604 of the inner structure 60 and protruded from a lower surface 64 of the inner structure 60. The lower surface 64 of the inner structure 60 may face the chassis 70 when the inner structure 60 and the chassis 70 are attached to each other. In some embodiments of the present disclosure, each of the retainers 65 has a slot 650. In some embodiments of the present disclosure, the positions of the slots 650 of the retainers 65 of the inner structure 60 are correspond to the position of the slot 720 of the chassis 70. Thus, when the inner structure 60 and the chassis 70 are attached to each other, the slots 650 of the retainers 65 of the inner structure 60 may align with the slot 720 of the chassis 70.

In some embodiments of the present disclosure, the screw holes 521, 522, 533 and 534 are formed to align with a central line longitudinally extending the inner structure 60.

Figure 10A:
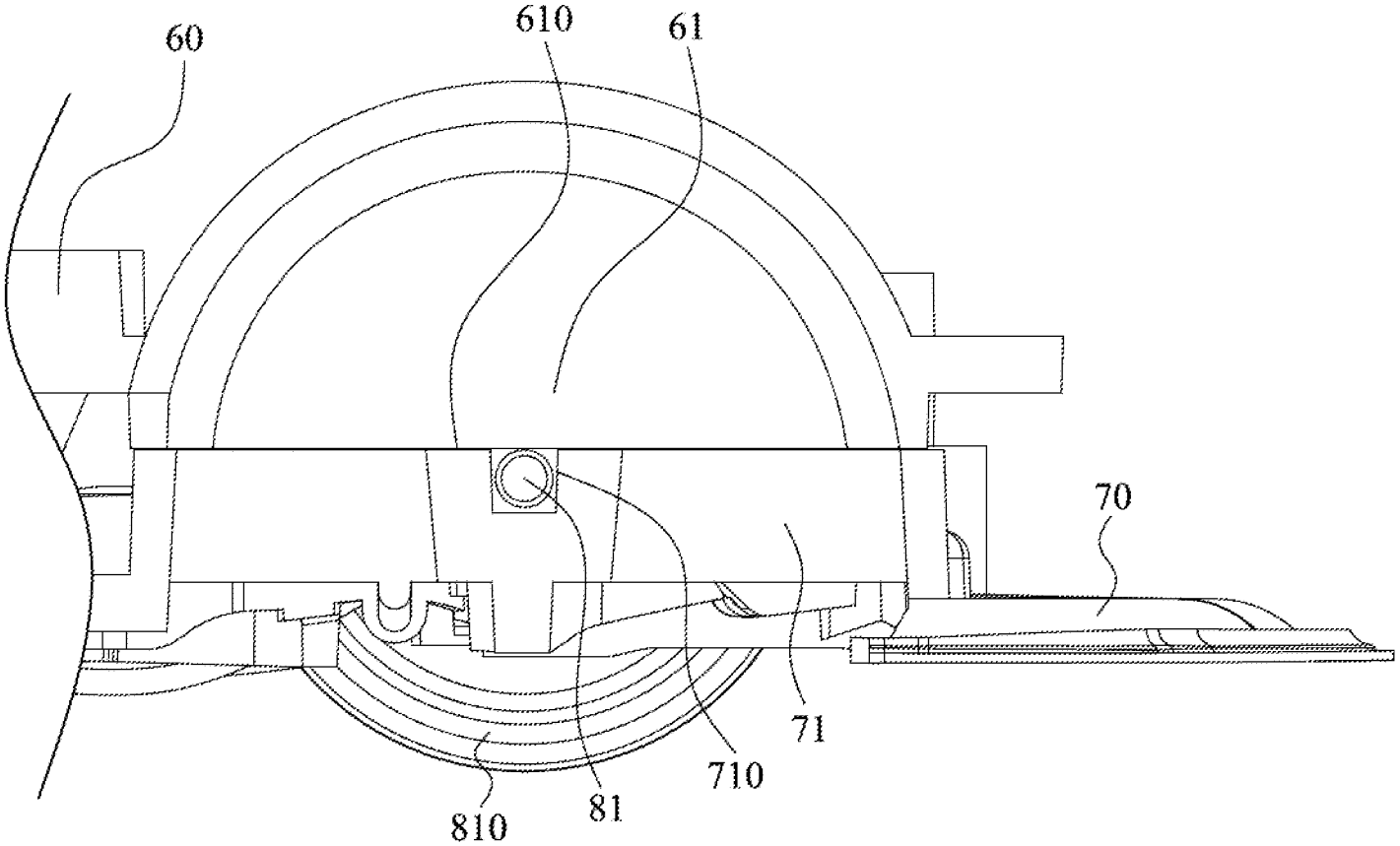
FIG. 10A is an enlarged cross-sectional view showing a portion of a combination of an inner structure and a chassis of a car type model in accordance with some embodiments of the present disclosure.

FIG. 10A is an enlarged cross-sectional view showing a portion of a combination of an inner structure and a chassis of a car type model in accordance with some embodiments of the present disclosure. As shown in FIG. 10A, the retainer 61 the inner structure 60 matches the retainer 71 of the chassis 70 and the lower surface 610 of the retainer 61 substantially covers the front slot 710 of the retainer 71 when the inner structure 60 and the chassis 70 are attached to each other. Referring to FIG. 10A, the front wheel axle 81 is received in the slot 710 of the retainer 71 of the chassis 70 and blocked by the lower surface 610 of the retainer 61 of the inner structure 60, and thus the front wheel axle 81 is positioned by the slot 710 of the retainer 71 and the lower surface 610 of the retainer 61. That is, the inner structure 60 and the chassis 70 are configured to keep the front wheel axle 81 in a position. in some embodiments of the present disclosure, a cross-sectional width of the slot 710 of the retainer 70 is greater than a diameter of the front wheel axle 81, and thus the front wheel axle 81 rotates freely in the slot 710 of the retainer 70.

In some embodiments of the present disclosure, the slot 710 of the chassis 70 is configured to fit the wheel axle 81, and the wheel axle 81 is fixed and cannot rotate freely when the wheel axle 81 is arranged between the inner structure 60 and chassis 70. The wheel 810 may rotatably connects the end of the wheel axle 81, and thus the wheel 810 may rotate freely while the wheel axle 81 is fixed between the inner structure 60 and chassis 70.

Figure 10B:
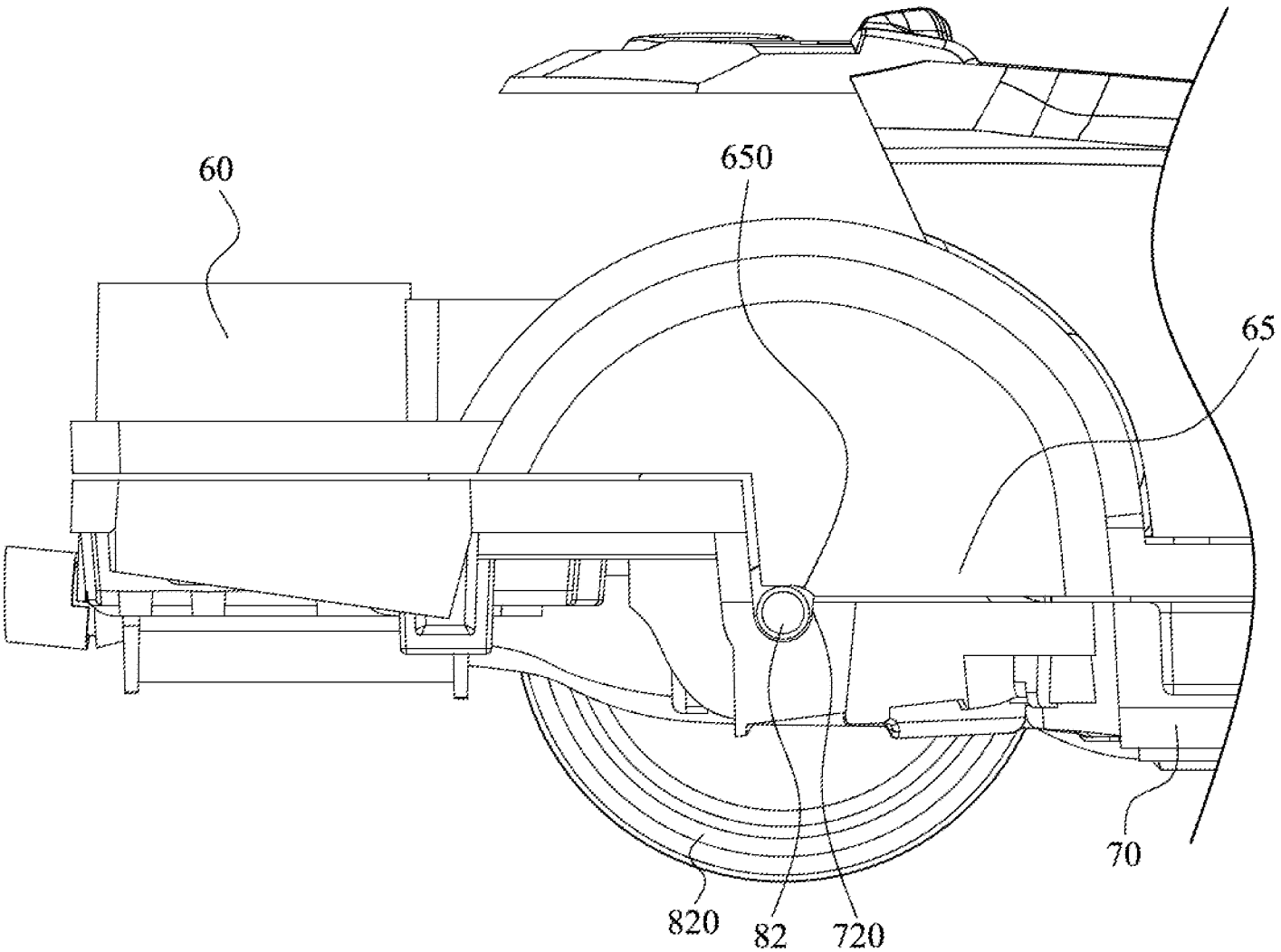
FIG. 10B is an enlarged cross-sectional view showing another portion of a combination of an inner structure and a chassis of a car type model in accordance with some embodiments of the present disclosure.

FIG. 10B is an enlarged cross-sectional view showing another portion of a combination of an inner structure and a chassis of a car type model in accordance with some embodiments of the present disclosure. As shown in FIG. 10B, the slot 650 of the retainer 65 of the inner structure 60 substantially aligns with the slot 720 of the chassis 70 when the inner structure 60 and the chassis 70 are attached to each other. Referring to FIG. 10B, the rear wheel axle 82 is received in the slot 650 of the retainer 65 of the inner structure 60 and the slot 720 of the chassis 70, and thus the rear wheel axle 82 is positioned by the slot 650 of the inner structure 60 and the rear slot 720 of the chassis 70. That is, the inner structure 60 and the chassis 70 are configured to keep the rear wheel axle 82 in a position. In some embodiments of the present disclosure, a cross-sectional width of the slot 650 of the inner structure 60 is greater than a diameter of the rear wheel axle 82 and a cross-sectional width of the slot 720 of the chassis 70 is greater than the diameter of the rear wheel axle 82, and thus the rear wheel axle 82 rotates freely in the slot 650 of the inner structure 60 and the slot 720 of the chassis 70.

In some embodiments of the present disclosure, the slot 650 of the inner structure 60 and the slot 720 of the chassis 70 are configured to fit the wheel axle 82, and the wheel axle 82 is fixed and cannot rotate freely when the wheel axle 82 is arranged between the inner structure 60 and chassis 70. The wheel 820 may rotatably connects the end of the wheel axle 82, and thus the wheel 820 may rotate freely while the wheel axle 82 is fixed between the inner structure 60 and chassis 70.

It will be further appreciated that the foregoing apparatus may be used for positioning the wheel axles and protecting the wheel axles from being bent or deformed. Further, the wheel axles are configured to rotate freely. Moreover, the inner structure formed of the metal can increase the weight of the car type model, and thus the car type model car can exhibit the massive feeling. In addition, since the chassis is made of the resin, a fine relief pattern could be easily formed at the lower surface of the chassis by the molding process.

As used herein, the singular terms "a," "an," and "the" may include a plurality of referents unless the context clearly dictates otherwise.

As used herein, the terms "approximately," "substantially," "substantial" and "about" are used to describe and account for small variations. When used in conjunction with an event or circumstance, the terms can refer to instances in which the event or circumstance occurs precisely as well as instances in which the event or circumstance occurs to a close approximation. For example, when used in conjunction with a numerical value, the terms can refer to a range of variation of less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, two numerical values can be deemed to be "substantially" the same or equal if the difference between the values is less than or equal to ±10% of an average of the values, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, "substantially" parallel can refer to a range of angular variation relative to 0° that is less than or equal to ±10°, such as less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°. For example, "substantially" perpendicular can refer to a range of angular variation relative to 90° that is less than or equal to ±10°, such as less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°.

Additionally, amounts, ratios, and other numerical values are sometimes presented herein in a range format. It is to be understood that such range format is used for convenience and brevity and should be understood flexibly to include numerical values explicitly specified as limits of a range, but also to include all individual numerical values or sub-ranges encompassed within that range as if each numerical value and sub-range were explicitly specified.

While the present disclosure has been described and illustrated with reference to specific embodiments thereof, these descriptions and illustrations do not limit the present disclosure. It should be understood by those skilled in the art that various changes may be made and equivalents may be substituted without departing from the true spirit and scope of the present disclosure as defined by the appended claims. The illustrations may not be necessarily drawn to scale. There may be distinctions between the artistic renditions in the present disclosure and the actual apparatus due to manufacturing processes and tolerances. There may be other embodiments of the present disclosure which are not specifically illustrated. The specification and drawings are to be regarded as illustrative rather than restrictive. Modifications may be made to adapt a particular situation, material, composition of matter, method, or process to the objective, spirit and scope of the present disclosure. All such modifications are intended to be within the scope of the claims appended hereto. While the methods disclosed herein are described with reference to particular operations performed in a particular order, it will be understood that these operations may be combined, sub-divided, or re-ordered to form an equivalent method without departing from the teachings of the present disclosure. Accordingly, unless specifically indicated herein, the order and grouping of the operations are not limitations on the present disclosure.

What is claimed is:

1. A car type model comprising:

an inner structure formed of a metal;

a chassis formed of a resin and attachable to the inner structure; and a wheel axle formed of a metal and disposable between the inner structure and the chassis;

wherein the inner structure and the chassis are configured to receive the wheel axle and keep the wheel axle in a position;

wherein the chassis comprises a pair of retainers protruding from a surface of the chassis toward the inner structure with the chassis attached to the inner structure and the surface of the chassis facing the inner structure, and each of the retainers of the chassis includes a slot configured to receive the wheel axle, and wherein the inner structure comprises a pair of retainers protruding from a surface of the inner structure toward the chassis with the inner structure attached to the chassis and the surface of the inner structure facing the chassis, and wherein the pair of retainers of the inner structure are configured to match the pair of retainers of the chassis.

2. The car type model of claim 1, wherein the surface of the inner structure comprises a flat portion and, with the chassis attached to the inner surface, the flat portion faces the chassis and substantially covers the slots of the retainers of the chassis.

3. The car type model of claim 1, wherein each of the retainers of the inner structure comprises a slot which substantially aligns with a respective one of the slots of the retainers of the chassis.

4. The car type model of claim 1, further comprising a car body formed of a resin and attachable to the inner structure.

5. The car type model of claim 1, wherein the chassis has a relief pattern on a surface facing away the inner structure.

6. The car type model of claim 1, wherein the wheel axle is configured to rotate freely.

7. The car type model of claim 1, wherein the chassis comprises a first member with a first screw hole formed thereon, the first screw hole provided between the pair of retainers of the chassis and protruding from the surface of the chassis which faces the inner structure, wherein the inner structure comprises a second member with a second screw hole formed thereon, the second screw hole provided between the pair of retainers of the inner structure and protruding from the surface of the inner structure which faces the chassis, and wherein the first member of the chassis and the second member of the inner structure fit each other, and a fixing screw is screwed into the first screw hole of the first member and the second screw hole of the second member so that the chassis is attached to the inner structure.

8. The car type model of claim 7, further comprising a car body formed of a resin, wherein the first screw hole is formed to align with a central line longitudinally extending the chassis, wherein the second screw hole is formed to align with a central line longitudinally extending the inner structure, wherein the inner structure comprises a third screw hole formed at a position avoiding the second screw hole, the position aligning with a center line longitudinally extending the inner structure, and wherein a fixing screw is screwed into the second screw hole of the inner structure and a screw hole provided on the car body so that the inner structure is attached to the car body.

9. The car type model of claim 1, wherein the retainers of the chassis are formed of the resin and formed with the chassis, and wherein the retainers of the inner structure are formed of the metal and formed with the inner structure.

10. The car model type of claim 1, wherein the chassis is attached to the inner structure with the wheel axle disposed between the chassis and the inner structure in the respective slots of the pair of retainers of the chassis and with the chassis and the inner structure keeping the wheel axis in the position.

11. A car type model comprising:

a chassis formed of a resin, wherein the chassis comprises at least one slot;

a wheel axle receivable in the slot of the chassis; and an inner structure formed of a metal and attachable to the chassis;

wherein the chassis comprises a pair of retainers protruding from a surface of the chassis toward the inner structure with the inner structure attached to the chassis and with the surface of the chassis facing the inner structure, and wherein the pair of retainers define the slot of the chassis;

wherein the inner structure comprises a pair of retainers protruding from a surface of the inner structure toward the chassis with the inner structure attached to the chassis and with the surface of the inner structure facing the chassis, and wherein the pair of retainers of the inner structure are configured to match the pair of retainers of the chassis;

wherein the pair of retainers of the inner structure cover the slot of the chassis such that the wheel axle is kept in the slot of the chassis when the inner structure is attached to the chassis and the wheel axle is received in the slot of the chassis.

12. The car type model of claim 11, wherein the inner structure comprises a flat lower surface covering the slot of the chassis with the inner structure attached to the chassis.

13. The car type model of claim 11, wherein the inner structure comprises a slot aligned with the slot of the chassis with the inner structure attached to the chassis.

14. The car type model of claim 11, wherein a cross-sectional width of the slot of the chassis is greater than a diameter of the wheel axle and thus the wheel axle rotates freely.

15. The car model type of claim 11, wherein the inner structure is attached to the chassis with the wheel axle received in the slot of the chassis and the retainer of the inner structure covering the slot of the chassis and keeping the wheel axle in the slot of the chassis.

* * * * *